US006006975A

United States Patent [19]

Ishizawa

[11] Patent Number: 6,006,975

[45] Date of Patent: Dec. 28, 1999

[54] PNEUMATICALLY OPERATED NAIL DRIVER

[75] Inventor: Yoshinori Ishizawa, Hitachinaka, Japan

[73] Assignee: Hitachi Koki Co., Ltd., Tokyo, Japan

[21] Appl. No.: 09/210,453

[22] Filed: Dec. 14, 1998

[30] Foreign Application Priority Data

Dec. 19, 1997 [JP] Japan ..... 9-350841

[51] Int. Cl.[6] ..... B25C 1/04

[52] U.S. Cl. ..... 227/119; 227/130; 227/136; 227/138

[58] Field of Search ..... 227/119, 109, 227/130, 136, 135, 138

[56] References Cited

U.S. PATENT DOCUMENTS 5,052,607 10/1991 Dutton ..... 227/119
5,199,627 4/1993 Christensen ..... 227/130
5,579,975 12/1996 Moorman ..... 227/119
5,738,266 4/1998 Ogawa ..... 227/119
5,803,338 9/1998 Singer et al. ..... 227/130

FOREIGN PATENT DOCUMENTS 5-44062 11/1993 Japan .

*Primary Examiner*—Scott A. Smith
*Attorney, Agent, or Firm*—Louis Woo

[57] ABSTRACT

A pusher piston shifts a nail by a predetermined distance along an eject hole before a driver blade drives the nail. In this case, the predetermined shifting distance of the pusher piston satisfies a requirement that the tip of the nail protrudes out of the eject hole while the nail itself is not removed off a band member. Thus, the nail is surely held by the band member even when the nail is positioned at the pushed-out position where the tip of the nail protrudes out of the eject hole.

2 Claims, 6 Drawing Sheets

PNEUMATICALLY OPERATED NAIL DRIVER

BACKGROUND OF THE INVENTION

The present invention relates to a pneumatically operated nail driver which has an eject hole for holding a nail, with the tip of the nail being pushed out by a predetermined amount from the edge of the eject hole.

A conventional nail driver is disclosed in Japanese Utility Model No. Hei 5-44062. This conventional nail driver has a pusher piston provided slidably in the up-and-down direction near the eject hole. A trigger valve is provided for controlling the nail driving mechanism. When the trigger valve is in an initial condition, compression air is introduced into an upper pusher chamber. The pusher piston is depressed downward to shift the nail positioned in the eject hole by a predetermined amount. The lower tip of the nail protrudes out of the eject hole. With this arrangement, it becomes possible to position the tip of the nail to a target point.

However, this conventional nail driver requires a vertical guide provided near the lower end of the eject hole to hold the nail after the nail is pushed out by the pusher piston. This arrangement is disadvantageous in that the total number of parts increases and the assembling is complicated. Furthermore, providing the vertical guide which has a relatively large diameter makes it difficult for the user to confirm the tip position of the nail.

SUMMARY OF THE INVENTION

An object of the present invention is to provide a pneumatically operated nail driver which is simple in arrangement, easy to assemble, and smooth in operation.

In order to accomplish this and other related objects, the present invention provides a pneumatically operated nail driver comprising a nail guide for loading a nail assembly of a plurality of nails serially connected by a band member, each nail being separable one after another from the nail assembly. A nail feeding mechanism is provided for successively feeding the nails from the nail guide one after another into an eject hole. A driver blade pushes a nail positioned in the eject hole and drives the nail out of the eject hole. A pusher piston shifts the nail by a predetermined distance along the eject hole before the driver blade drives the nail. In this case, the predetermined shifting distance of the pusher piston satisfies a requirement that the tip of the nail protrudes out of the eject hole while the nail itself is not removed off the band member. Thus, the nail is surely held by the band member even when the nail is positioned at the pushed-out position where the tip of the nail protrudes out of the eject hole.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF THE PREFERRED EMBODIMENT

A preferred embodiment of the present invention will be explained with reference to the attached drawings. In following explanation, directions are based on a nail driver stationarily held in a vertical position with a driving direction extending downward. Needless to say, the actual directions of the nail driver will be frequently changed when operated.

Figure 1:
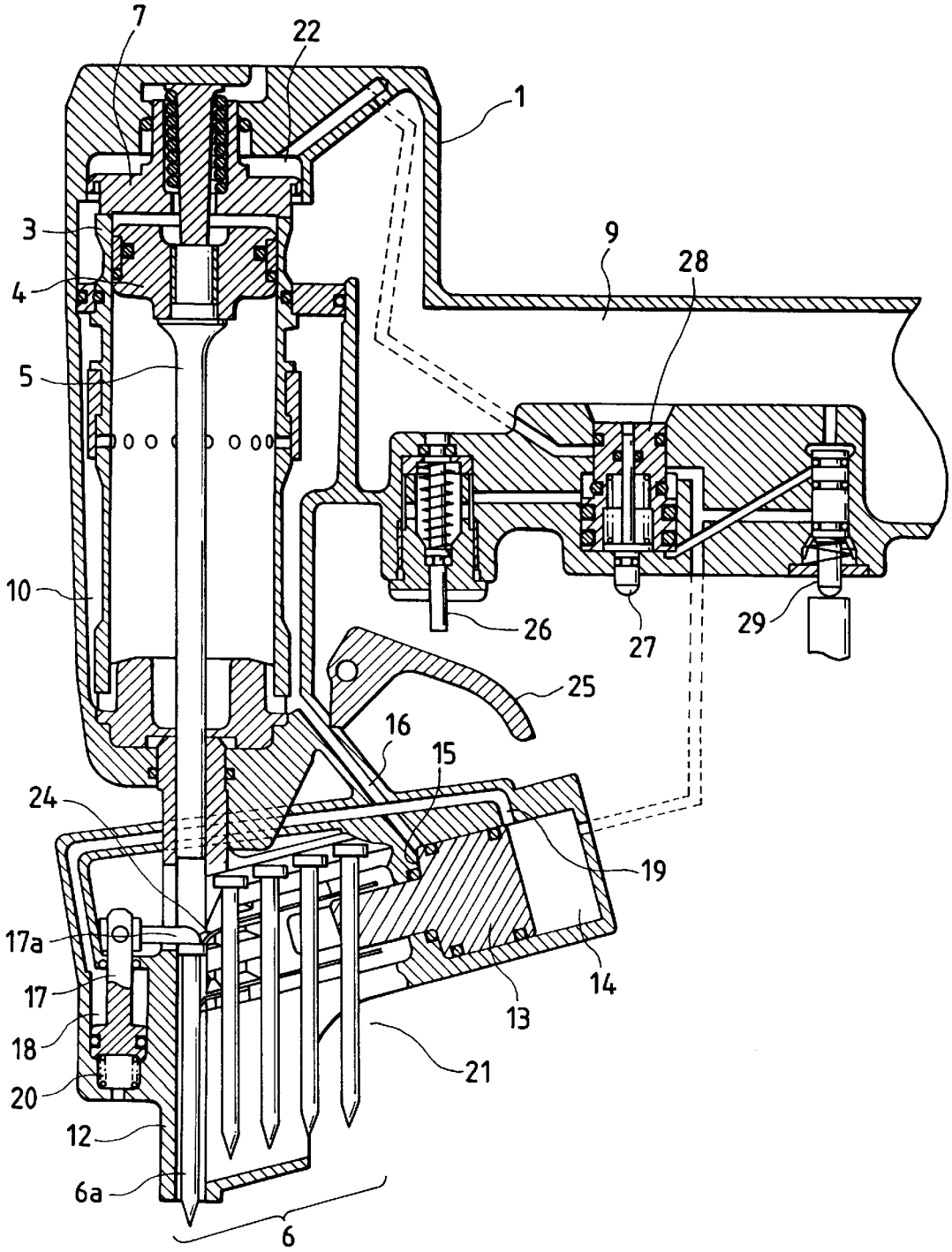
FIG. 1 is a cross-sectional side view showing an arrangement of a pneumatically operated nail driver in accordance with a preferable embodiment of the present invention.

FIG. 1 shows a preferable embodiment of a pneumatically operated nail driver. In a main body 1, a strike piston 4 is slidably accommodated in a cylinder 3. The strike piston 4 reciprocates in the axial direction of the cylinder 3. A driver blade 5 is integrally attached to the strike piston 4. An eject hole 12 is provided at the lower portion of the main body 1. A leading (or first) nail 6*a* of a nail assembly 6, i.e., the leading nail of serially connected nails, is positioned in the eject hole 12 coaxially with the driver blade 5 so that the nail 6*a* is driven by the driver blade 5. A head valve 7 is provided for connecting or disconnecting the inside space of the cylinder 3 with or from an accumulation chamber 9. The accumulation chamber 9 is connected to a compressor (not shown) and stores pressurized air. A return air chamber 10 stores compression air which is used for returning the driver blade 5 to the initial or original (i.e. upper end) position.

The eject hole 12 guides the driver blade 5 along its axis (i.e., in a nail driving direction). A feeder piston 13, provided in a later-described nail guide 21, successively supplies the nails one after another into the eject hole 12 in response to each completion of the nail driving operation so that the leading nail 6*a* of the nail assembly 6 is positioned in the eject hole 12 for the next nail driving operation. When compression air rushes into an upper feeder chamber 14, the feeder piston 13 slides toward the eject hole 12. A lower feeder chamber 15 communicates with the return air chamber 10 via an air passage 16.

A pusher piston 17, provided near the eject hole 12, is slidable in the up-and-down direction. A stopper lever 17*a*, hingedly supported at the upper end of the pusher piston 17, is protrusible into the eject hole 12. When compression air rushes into an upper pusher chamber 18, the pusher piston 17 moves downward. An air passage 19 connects the upper feeder chamber 14 to the upper pusher chamber 18 when the feeder piston 13 dislocates toward the eject hole 12 and reaches the most advanced position. A spring 20 resiliently urges the pusher piston 17 upward. The nail guide 21, loading the nail assembly 6, is open/close operable.

An upper header chamber 22 is provided above the head valve 7. A band member (e.g., a metallic connecting member) 24 is used to bundle the nails into the nail assembly 6. A trigger valve 26, in a normal condition, connects the accumulation chamber 9 to the upper feeder chamber 14 via a later-described startup piston 28. The trigger valve 26, in an operational condition, disconnects the accumulation chamber 9 from the upper feeder chamber 14 and from the upper header chamber 22. In this case, both the upper feeder chamber 14 and the upper header chamber 22 are opened to the air.

A startup plunger 27 is associated with the startup piston 28. A door valve 29 is responsive to an opened condition of the nail guide 21 and lifts the startup piston 28 upward when the nail guide 21 is opened. The startup piston 28 stays at the upper position until the startup plunder 27 is pulled. When held at the upper position, the startup piston 28 disconnects the trigger valve 26 from the upper header chamber 22 and also from the upper feeder chamber 14. However, the startup piston 28 connects the accumulation chamber 9 to the upper header chamber 22. Thus, after the nail guide 21 is opened, unless the startup plunger 27 is pulled, no nail driving operation is performed and both the feeder piston 13 and the pusher piston 17 are deactivated. This arrangement prevents the pusher piston 17 from accidentally driving the nail 6*a* in the eject hole 12 via the driver blade 5 immediately after the nail guide 21 is closed again.

Figure 2:
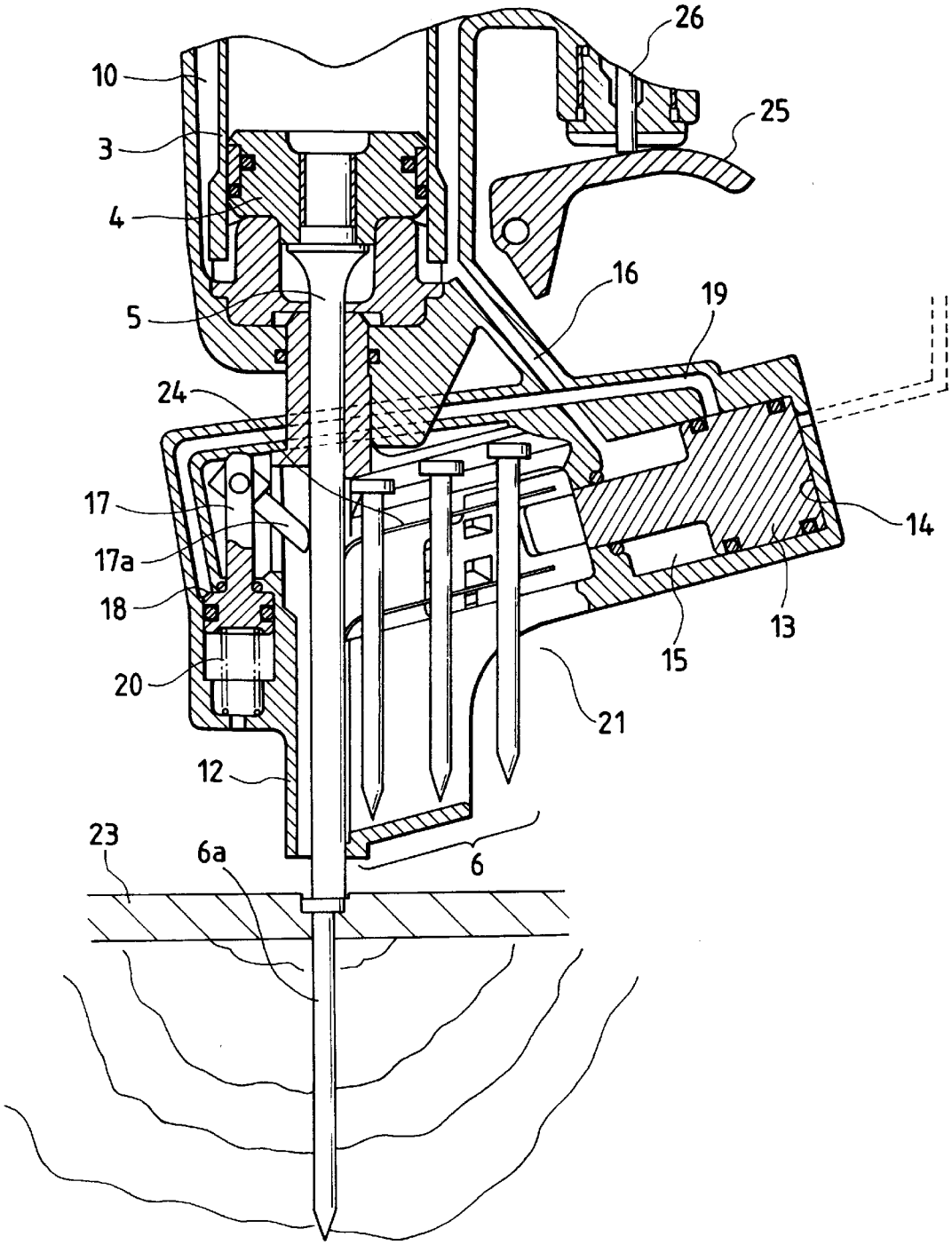
FIG. 2 is an enlarged cross-sectional view showing an operated condition of the nail driver shown in FIG. 1.

The above-described nail driver operates in the following manner. FIG. 1 shows the initial condition of the nail diver before starting the nail driving operation. FIG. 2 shows the condition of the nail driver after having finished the driving operation. In the initial condition shown in FIG. 1, the user pulls the trigger 25 to operate the trigger valve 26. The trigger valve 26 discharges the compression air from the upper header chamber 22, the upper feeder chamber 14, and the upper pusher chamber 18. The head valve 7 shifts upward. The pusher piston 17, being resiliently urged by the spring 20, shifts upward. When the head valve 7 shifted upward, the accumulation chamber 9 communicates with the inside space of the cylinder 3. The compression air rushes into the cylinder 3 from the accumulation chamber 9. The strike piston 4 and the driver blade 5 receive the pressure of the compression air and rapidly move downward along the axial direction of the cylinder 3. At the same time, the compression air flows into the return air chamber 10. The compression air further flows into the lower feeder chamber 15 from the return air chamber 10 via the air passage 16. Thus, the feeder piston 13 moves backward before the driver blade 5 enters into the eject hole 12. Then, the driver blade 5 drives the nail 6*a* out of the eject hole 12 to a woody or similar material 23 as shown in FIG. 2.

Figure 3:
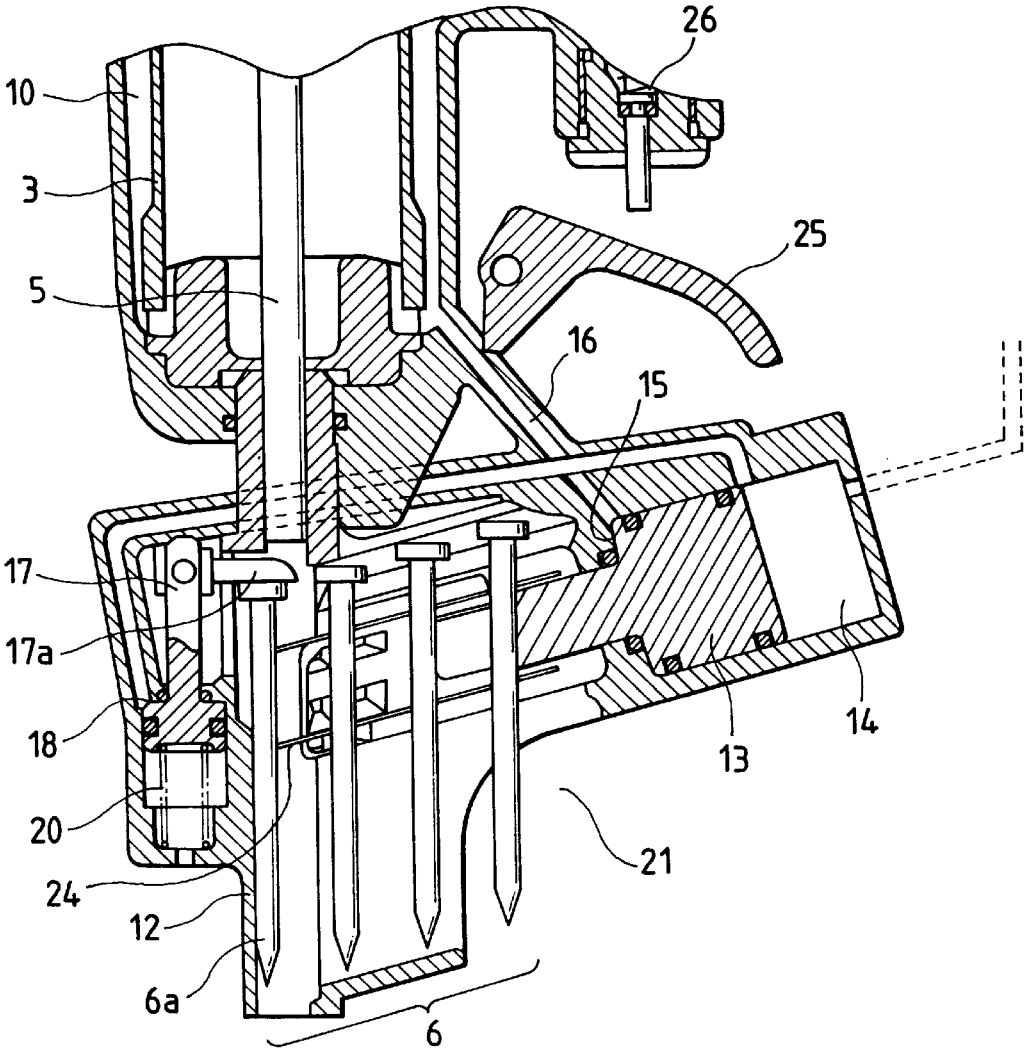
FIG. 3 is an enlarged cross-sectional view showing an operated condition of the nail driver shown in FIG. 1.
Figure 4:
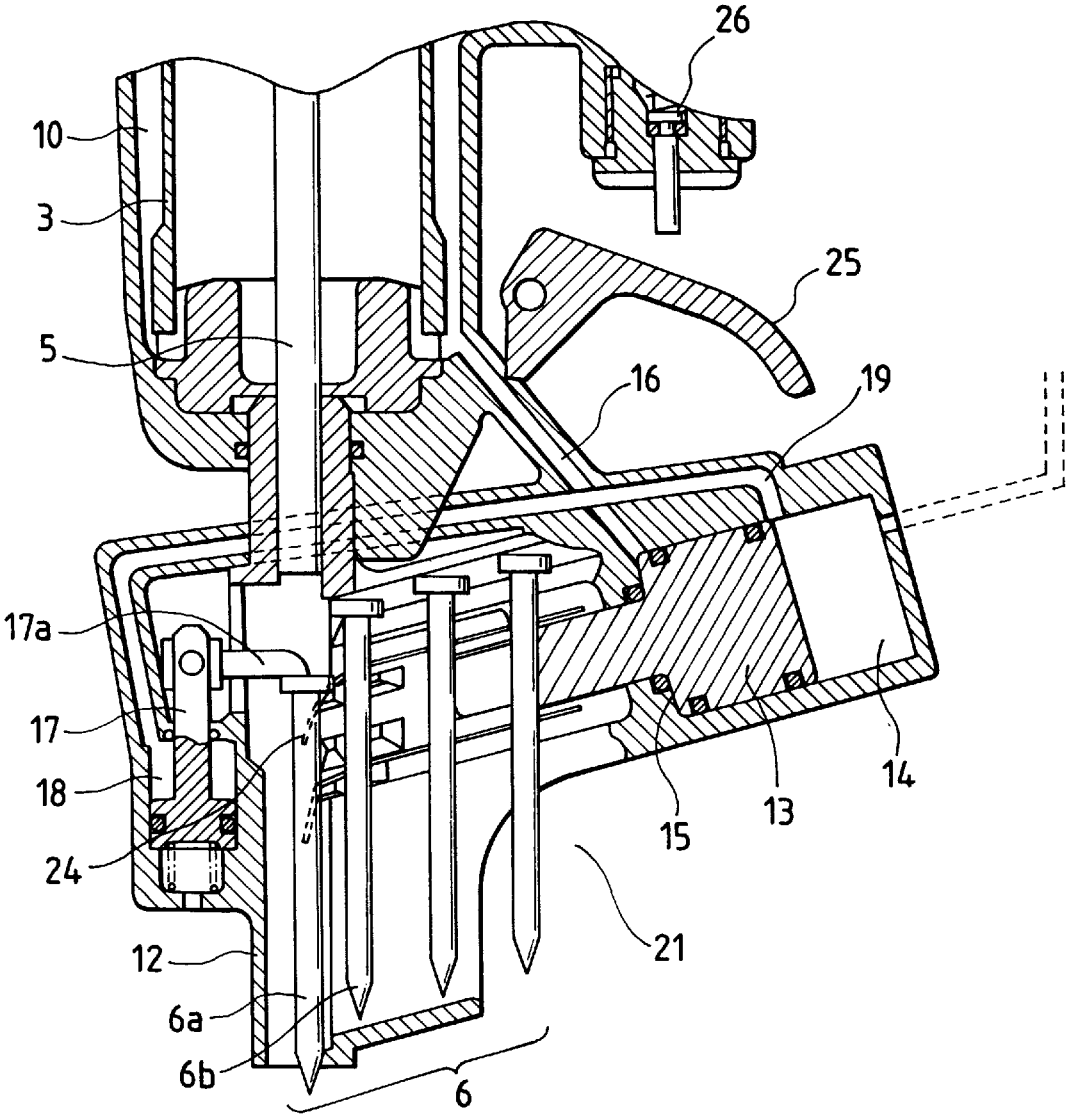
FIG. 4 is an enlarged cross-sectional view showing an operated condition of the nail driver shown in FIG. 1.

After finishing the nail driving operation, the user releases the trigger 25. The trigger valve 26 returns to the initial condition shown in FIG. 1. Both the upper header chamber 22 and the upper feeder chamber 14 communicate with the accumulation chamber 9. The head valve 7 moves downward. The inside space of the cylinder 3 is thus disconnected from the accumulation chamber 9. The compression air, stored in the return air chamber 10, pushes the strike piston 4 and the driver blade 5 back (i.e., upward) to their initial positions shown in FIG. 1. At the same time, the feeder piston 13 moves toward the eject hole 12 so as to guide the leading nail 6*a* of the nail assembly 6 into the eject hole 12. When the feeder piton 13 reaches the most advanced position, the upper feeder chamber 14 communicates with the upper pusher chamber 18 via the air passage 19, as shown in FIG. 3. The compression air rushes into the upper pusher chamber 18. Thus, the pusher piston 17 moves downward to protrude the tip of nail 6*a* out of the eject hole 12, as shown in FIG. 4.

Thereafter, the user pulls the trigger 25 to operate the trigger valve 26. The upper pusher chamber 18 is opened to the air via the trigger valve 26. The compression air is discharged from the upper pusher chamber 18. Hence, the pusher piston 17 returns to the original position (i.e. the upper position) by being resiliently urged by the spring 20. Subsequently, as shown in FIG. 2, the driver blade 5 drives the nail 6*a* out of the eject hole 12.

Figure 5:
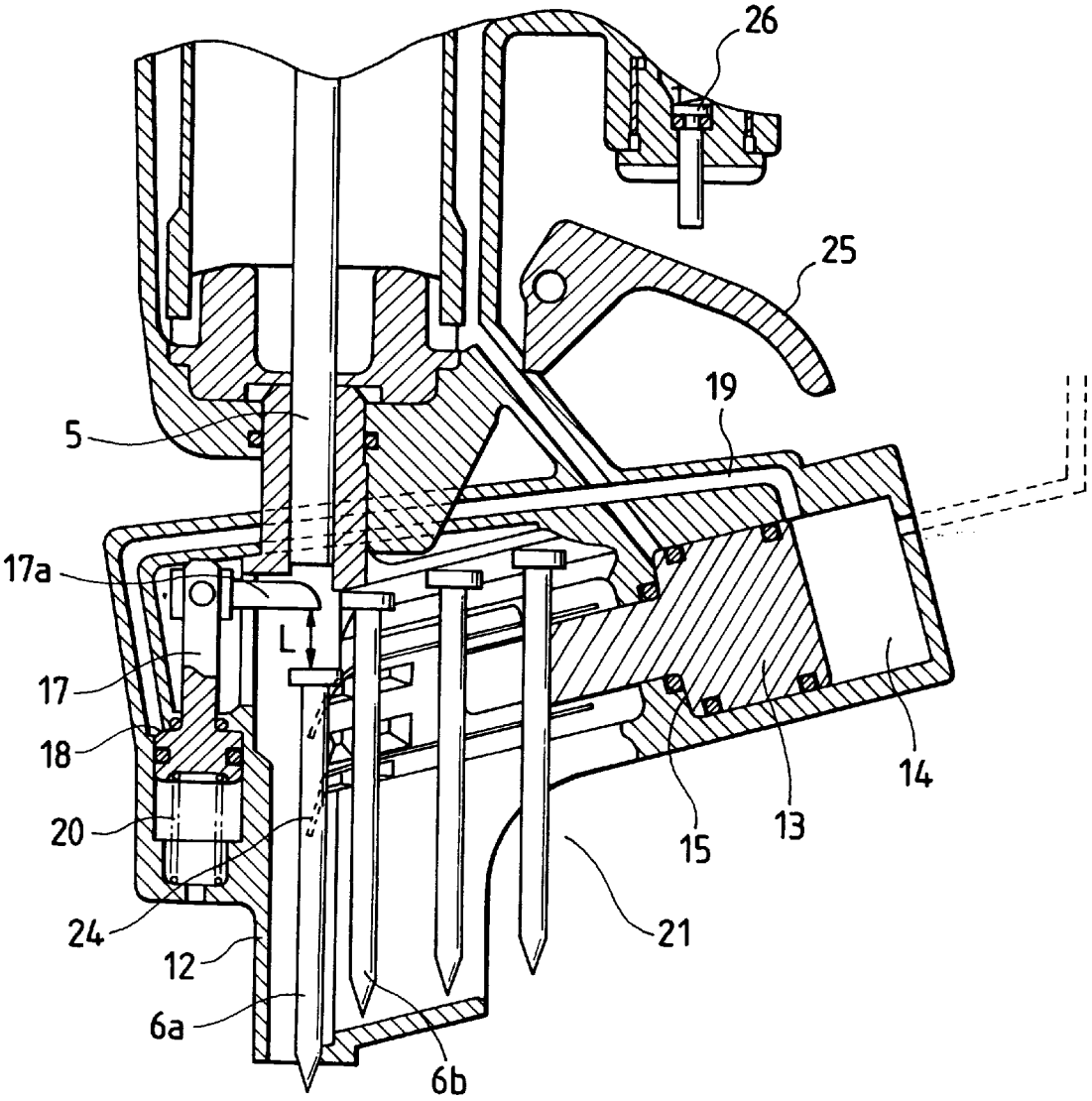
FIG. 5 is an enlarged cross-sectional view showing an operated condition of the nail driver shown in FIG. 1.

In the above-described nail driving operation, the pusher piston 17 moves or reciprocates by a predetermined distance L in the up-and-down direction as shown in FIG. 5. This up-and-down distance L is substantially identical with the shifting distance of the nail 6*a* which is pushed by the stopper lever 17*a* of the pusher piston 17. According to this embodiment, this up-and-down distance L is determined in a predetermined range so as to satisfy the following conditions.

When the pusher piston 17 moves by this distance L in the up-and-down distance, the tip of the leading nail 6*a* protrudes out of the eject hole 12. However, the leading nail 6*a* is still connected to the second nail 6*b* which is positioned next to the leading nail 6*a*, although the faster member 24 may deform downward, as shown in FIGS. 4 and 5. Thus, the leading nail 6*a* is held in the eject hole 12 by the band member 24.

Figure 6:
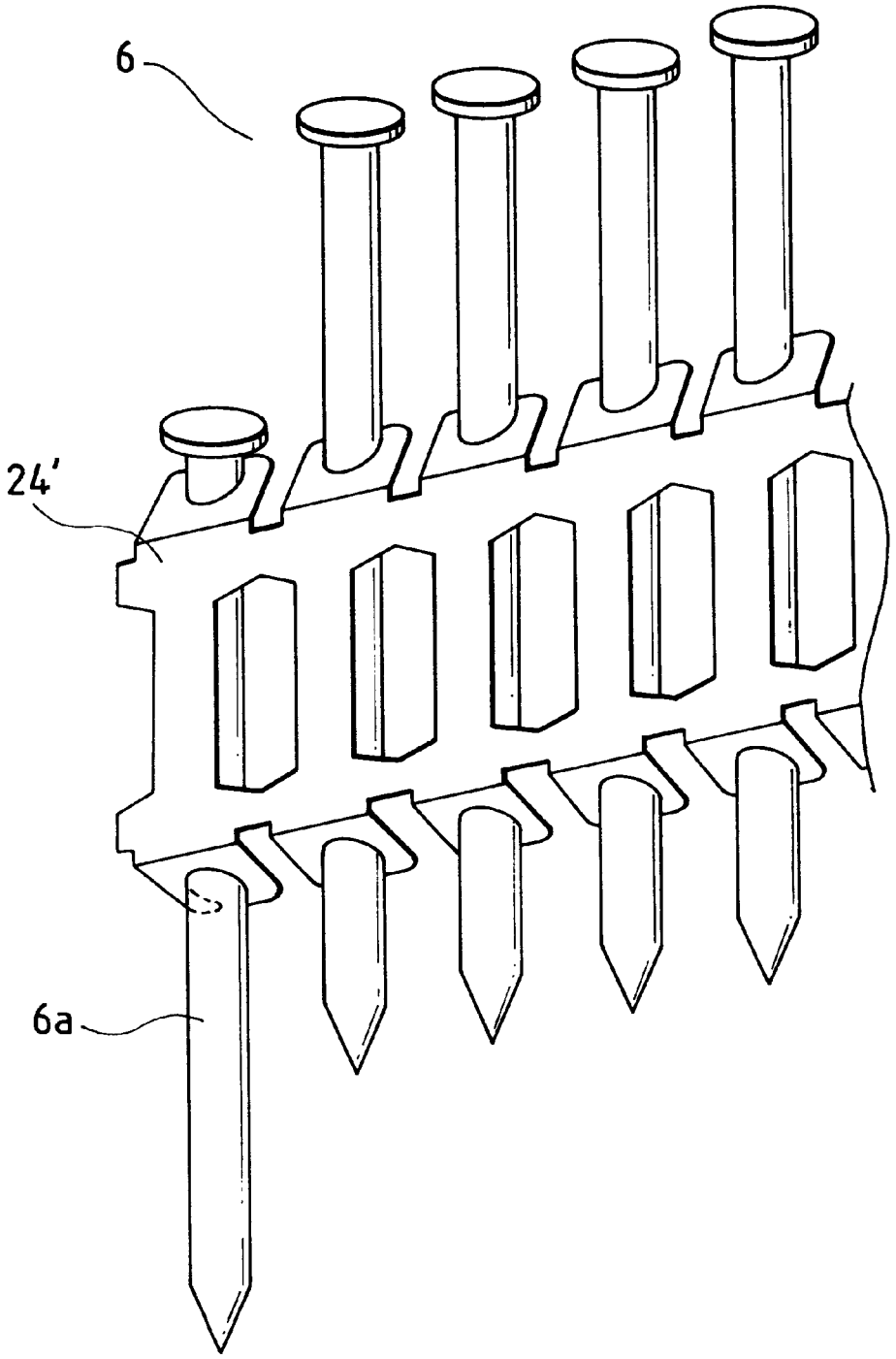
FIG. 6 is a perspective view showing one example of a nail assembly.

The band member 24, shown in FIGS. 1 through 5, may be formed by a steel wire. However, it is possible to use a plastic connecting member 24' shown in FIG. 6. In this case, the up-and-down distance L of the pusher piston 17, i.e., the shifting distance of the nail 6*a* which is pushed by the stopper lever 17*a*, satisfies the requirement that the nail 6*a* does not fall off the connecting member 24' while the tip of the nail 6*a* protrudes out of the eject hole 12 when the nail 6*a* is pushed downward by the stopper lever 17*a* of the pusher piston 17.

As explained in the foregoing description, the present invention sets the shift amount of the pusher piston so as to satisfy the requirement that the nail in the eject hole is not removed off the band member connecting the nails while the tip of the nail protrudes out of the eject hole when the nail is pushed downward by the stopper of the pusher piston. Thus, there is no necessity of providing a nail holder, such as a vertical guide, near the lower end of the eject hole. The total number of parts can be reduced. Assembling of the nail driver is simplified. Furthermore, it becomes easy for the user to confirm the tip end position of the pushed out nail when this nail driver is practically used.

This invention may be embodied in several forms without departing from the spirit of essential characteristics thereof. The present embodiment as described is therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A pneumatically operated nail driver comprising:

a nail guide for loading a nail assembly of a plurality of nails serially connected by a band member, each nail being separable one after another from said nail assembly;

a nail feeding mechanism for successively feeding the nails from said nail guide one after another into an eject hole;

a driver blade for pushing a nail positioned in said eject hole and driving said nail out of the eject hole; and a pusher piston for shifting said nail by a predetermined distance along said eject hole so as to cause the tip of said nail to protrude out of said eject hole without removing said nail from said band member, so that said nail is held in place by said band member before being driven by said driver blade.

2. The nail driver of claim 1, wherein said pusher piston comprises:

a piston member reactable to compressed air so as to be movable along an axis parallel to that of said driver blade; and a stopper lever movably coupled to said piston member at a right angle so as to extend partially into said eject hole and be positioned to be in contact with the top of said nail when said nail is fed to said eject hole;

wherein said stopper lever shifts said nail said predetermined distance when said piston member is driven by compressed air; and wherein after the tip of said nail has been driven to protrude out of said eject hole and said piston member has returned to its rest position, said stopper lever further being pivotable toward said piston member so that when said driver blade moves for pushing said nail out of said eject hole, said stopper lever is pivoted out of the way of said driver blade when contacted thereby.

* * * * *